US007553195B2

(12) United States Patent
Matsumoto et al.

(10) Patent No.: US 7,553,195 B2
(45) Date of Patent: Jun. 30, 2009

(54) PLUG

(75) Inventors: Ryota Matsumoto, Tokyo (JP); Ichiro Nakajima, Chiba (JP); Osamu Koshida, Saitama (JP); Shinya Yudate, Ehime (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/899,055

(22) Filed: Sep. 4, 2007

(65) Prior Publication Data

US 2008/0090465 A1 Apr. 17, 2008

(30) Foreign Application Priority Data

Sep. 8, 2006 (JP) ..... 2006-243904

(51) Int. Cl.
*H01R 24/04* (2006.01)

(52) U.S. Cl. ..... 439/669

(58) Field of Classification Search ..... 439/668, 439/669, 944, 675, 188, 355
See application file for complete search history.

(56) References Cited

U.S. PATENT DOCUMENTS

| | | | | |
|---|---|---|---|---|
| 6,394,852 | B1 | 5/2002 | Huang | |
| 6,439,933 | B1 | 8/2002 | Moji | |
| 6,461,199 | B1 * | 10/2002 | Koga et al. | 439/668 |
| 6,616,487 | B1 * | 9/2003 | Lai | 439/668 |
| 6,964,586 | B2 * | 11/2005 | Siddiqui | 439/669 |
| 2008/0226091 | A1 | 9/2008 | Matsumoto et al. | |

FOREIGN PATENT DOCUMENTS

| | | |
|---|---|---|
| EP | 1202400 A | 5/2002 |
| EP | 1511128 A | 3/2005 |
| JP | 09-204966 | 8/1997 |
| WO | 02/052684 A | 7/2002 |

* cited by examiner

*Primary Examiner*—Alexander Gilman
(74) *Attorney, Agent, or Firm*—Wolf, Greenfield & Sacks, P.C.

(57) ABSTRACT

Herein disclosed a plug, including: a first conductor; a first insulator; a second conductor; a second insulator; a third conductor; a third insulator; a fourth conductor; a fourth insulator; and a fifth conductor.

9 Claims, 14 Drawing Sheets

PLUG

CROSS REFERENCES TO RELATED APPLICATIONS

The present invention contains subject matter related to Japanese Patent Application JP 2006-243904 filed in the Japan Patent Office on Sep. 8, 2006, the entire contents of which being incorporated herein by reference.

BACKGROUND OF THE INVENTION

1. Field of the Invention

This invention relates to a plug, and more particularly to a plug which has a five-pole configuration.

2. Description of the Related Art

A plug to be connected to a jack of various electronic equipments such as, for example, an acoustic equipment is provided at an end portion of, for example, an earphone, a headphone, or various connection cables.

Generally, such a plug as described above such as, for example, a plug provided on an earphone, a headphone or the like, has a three-pole configuration for a speaker L (left), a speaker R (right) and the ground as disclosed, for example, in Japanese Patent Laid-Open No. Hei 9-204966 (hereinafter referred to as Patent Document 1).

SUMMARY OF THE INVENTION

However, in a sound inputting apparatus such as an earphone or a headphone connected to an acoustic equipment or the like, one plug may be connected to two sounding inputting apparatus such that different sound signals are transmitted individually from the single plug to the two sound inputting apparatus. In this instance, two poles for a speaker are required for each of the two sound inputting apparatus. Therefore, a plug of a three-pole configuration cannot be applied as the plug because of shortage of the number of poles.

Also in a headset or the like wherein different sound signals are outputted to left and right speakers and sound signals inputted to different microphones are inputted to an acoustic equipment, a plug of a three-pole configuration lacks in the number of poles.

On the other hand, upon formation of a plug of a configuration which has a number of poles increased from three poles, it is necessary to achieve facilitation in fabrication.

Therefore, it is demanded to provide a plug which solves such problems as described above and can be formed readily in a five-pole configuration.

According to the present invention, the connection positions of a plurality of insulators and a plurality of conductors are contrived specifically.

More particularly, according to the present invention, there is provided a plug including a first conductor formed as a bar and having an electrode portion and a fitting portion, a first insulator outwardly fitted with the fitting portion of the first conductor, a second conductor outwardly fitted with the first insulator and having an electrode portion and a fitting portion, the second conductor being isolated from the first conductor by the first insulator, a second insulator outwardly fitted with the fitting portion of the second conductor, a third conductor outwardly fitted with the second insulator and having an electrode portion and a fitting portion, the third conductor being isolated from the second conductor by the second insulator, a third insulator outwardly fitted with the fitting portion of the third conductor, a fourth conductor outwardly fitted with the third insulation portion and having an electrode portion, the fourth conductor being isolated from the third conductor by the third insulator, a fourth insulator attached at least to a portion of the outer face of the fourth conductor, and a fifth conductor attached to the fourth insulator.

In the plug, the second, third and fourth conductors are outwardly fitted around the first conductor, and the fifth conductor is provided on the outer side of and coupled to the conductors.

The above and other features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENT

A plug described below is applied, for example, to a sound inputting and outputting apparatus not shown such as an earphone or a headphone or the like called headset wherein a speaker is built in each of a pair of auricle mounting portions of the sound inputting and outputting apparatus and an arm is projected from one of the auricle mounting portions and has a microphone built in an end portion thereof.

Further, the plug described below may be applied to an electronic equipment wherein the plug is connected to two sound inputting apparatus individually having a pair of speakers and a sound signal is transmitted individually to the two sound input apparatus. The plug described below can be applied arbitrarily to various electronic equipments which require five poles.

Figure 1:
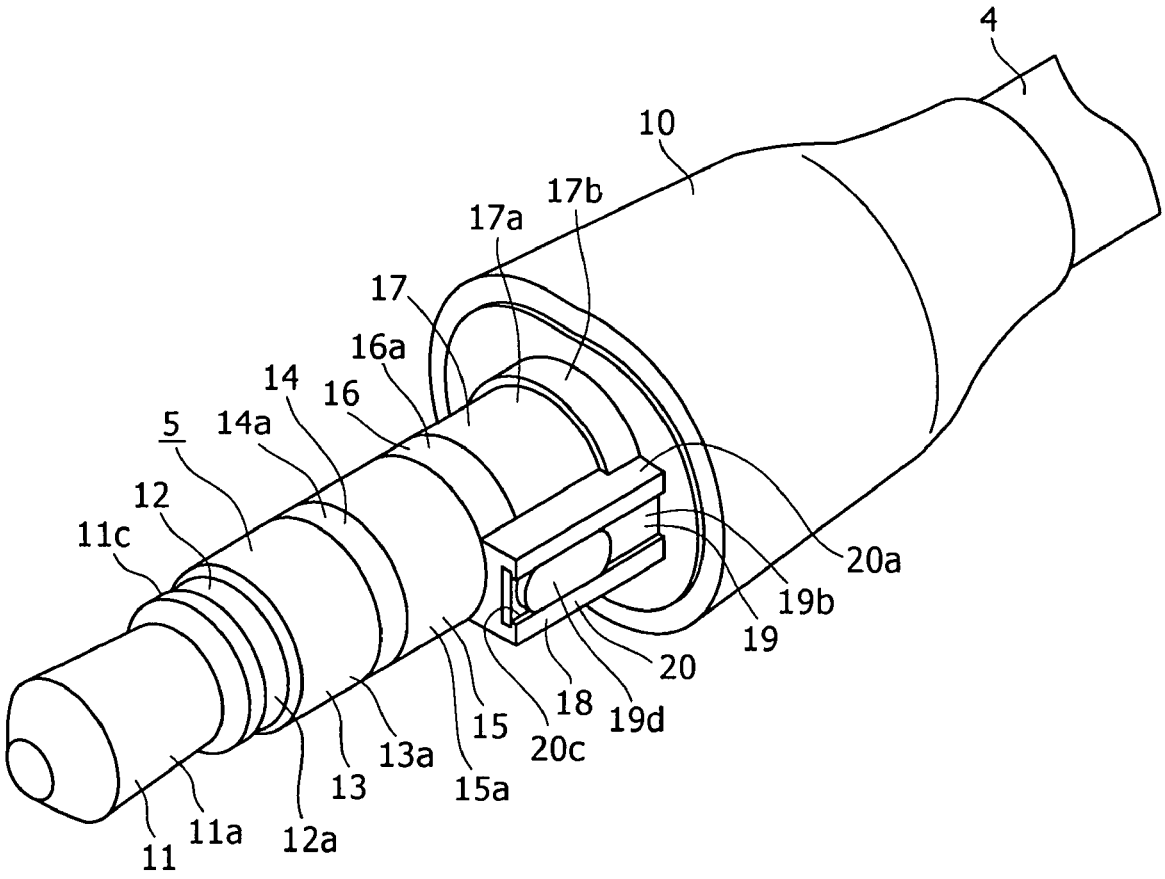
FIG. 1 is an enlarged perspective view showing a plug to which the present invention is applied.
Figure 2:
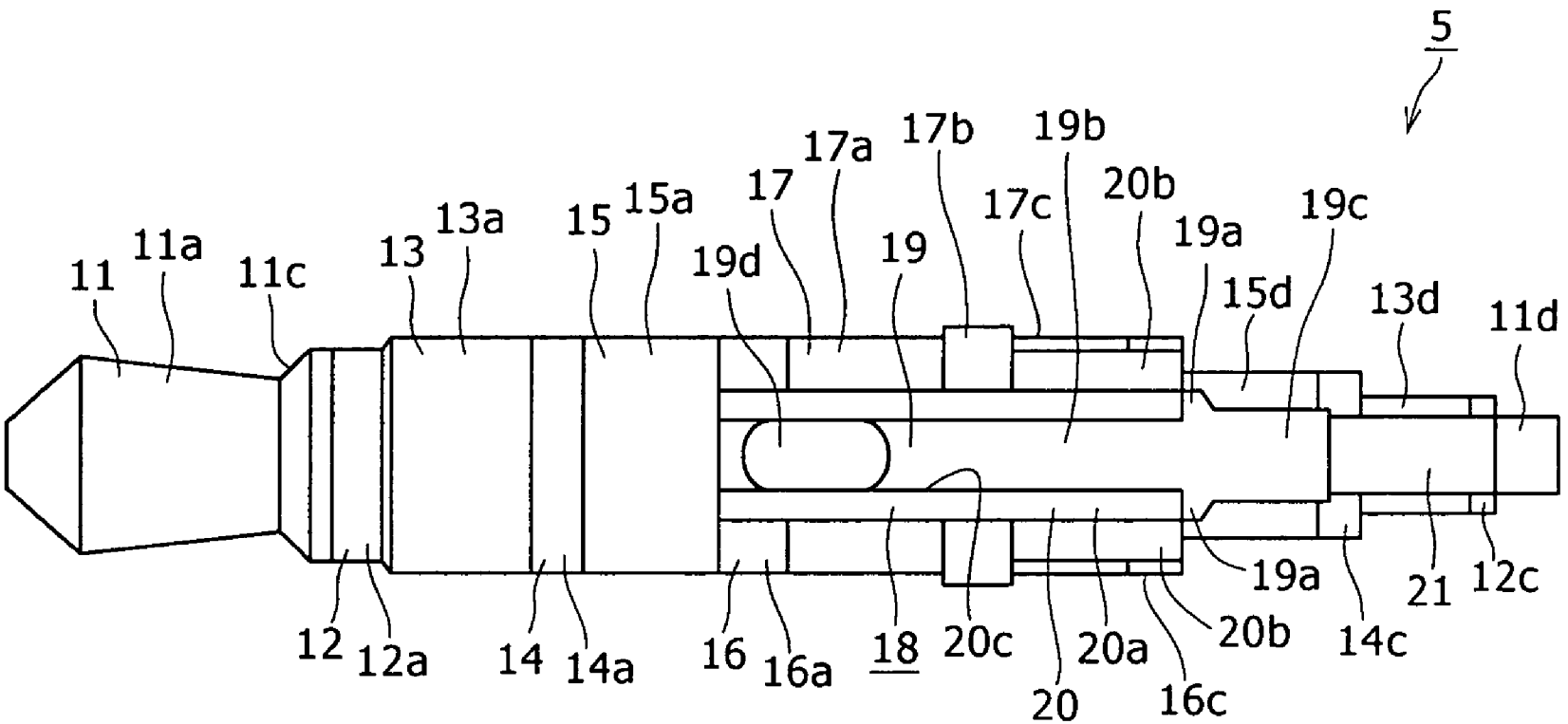
FIG. 2 is an enlarged side elevational view of the plug.
Figure 3:
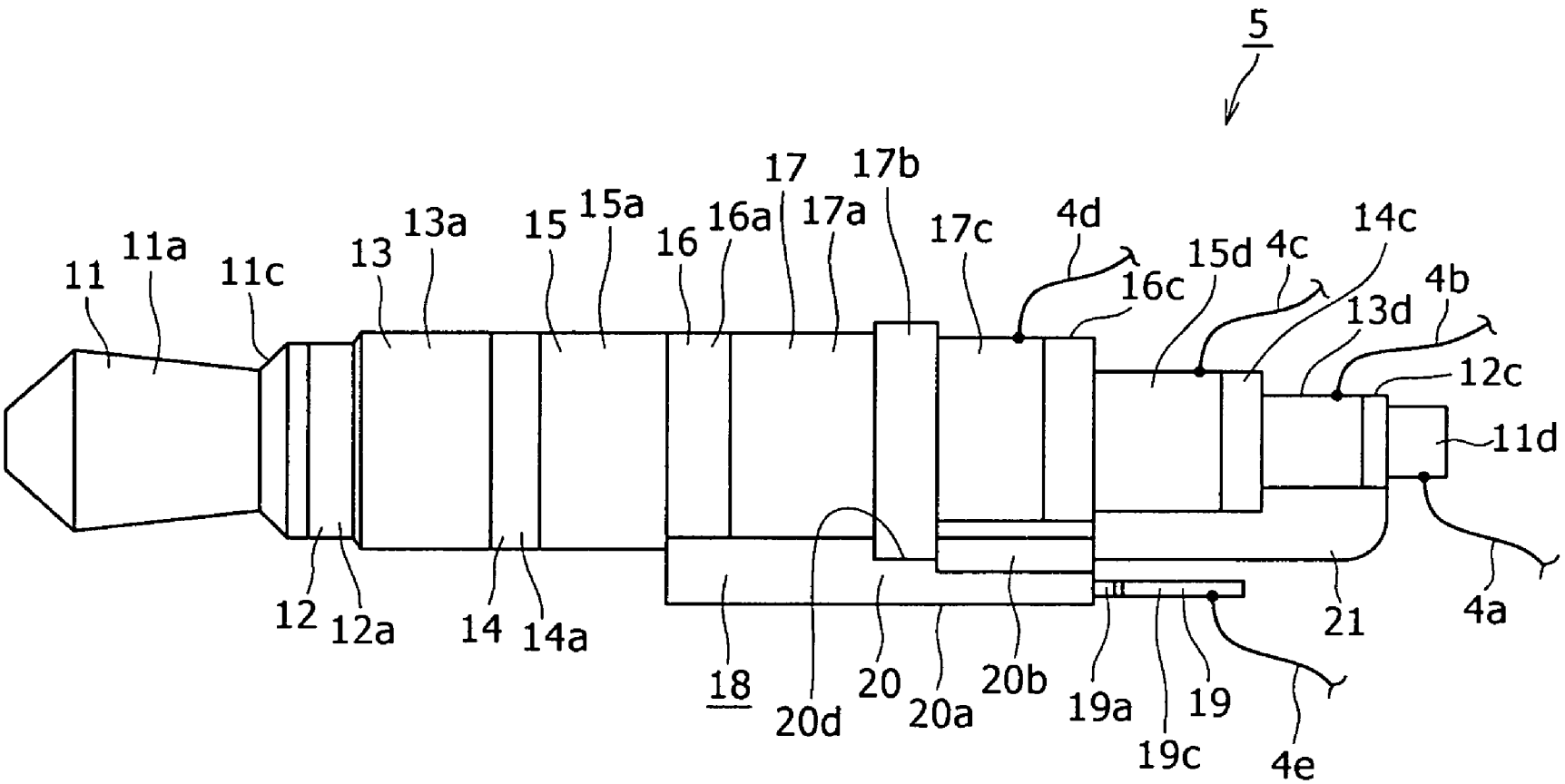
FIG. 3 is an enlarged side elevational view of the plug as viewed from a direction different from that in FIG. 2.

Referring now to FIGS. 1 to 3, a plug 5 is provided at an end of portion a connection cable 4 of a sound inputting and outputting apparatus not shown such as, for example, an earphone or a headphone. The plug 5 includes a first conductor 11, a first insulator 12, a second conductor 13, a second insulator 14, a third conductor 15, a third insulator 16, a fourth conductor 17, a fourth insulator 18 and a fifth conductor 19. The first, second, third, fourth and fifth conductors 11, 13, 15, 17 and 19 are made of a metal material having high electrical conductivity. Meanwhile, the first, second, third and fourth insulators 12, 14, 16 and 18 are made of a material which does not have electrical conductivity such as a resin material or the like.

The first, second, third, fourth and fifth conductors 11, 13, 15, 17 and 19 are used, for example, as a first speaker terminal, a second speaker terminal, a first microphone terminal, a grounding terminal and a second microphone terminal which are not shown, respectively.

It is to be noted that, while the first, second, third, fourth and fifth conductors 11, 13, 15, 17 and 19 are described as being used, for example, as a first speaker terminal, a second speaker terminal, a first microphone terminal, a grounding terminal and a second microphone terminal which are not shown, respectively, it may be determined arbitrarily as what terminals the first, second, third, fourth and fifth conductors 11, 13, 15, 17 and 19 should individually be used.

The first conductor 11 is formed as a substantially bar and has an electrode portion 11*a* of a large diameter and a fitting portion 11*b* of a small diameter. The first conductor 11 has a flange portion 11*c* provided between thereon the electrode portion 11*a* and the fitting portion 11*b* in such a manner as to be swollen outwardly. The first conductor 11 further has a cable connection portion 11*d* provided at an end portion of the fitting portion 11*b* thereof remote from the flange portion 11*c*.

The first conductor 11 further has an inclination face 11*e* formed on the outer periphery of the electrode portion 11*a* thereof such that it is inclined so as to displace to the center side of the bar toward the fitting portion 11*b*. The length of the fitting portion 11*b* in the axial direction is greater than that of the electrode portion 11*a*. The diameter of the cable connection portion 11*d* is smaller than that of the electrode portion 11*a* but greater than that of the fitting portion 11*b*.

The first insulator 12 is formed in a substantially cylindrical shape and has a large diameter portion 12*a* provided at an end portion thereof in the axial direction and having an outer diameter greater than that of the other portion which is therefore formed as a small diameter portion 12*b*. The large diameter portion 12*a* is formed with a thickness greater than that of the small diameter portion 12*b*. A swollen portion 12*c* is formed at an end portion of the small diameter portion 12*b* remote from the large diameter portion 12*a* such that it is swollen a little outwardly in a radial direction of the bar. Further, a shallow fitting concave portion 12*d* is formed on the outer face side of the first insulator 12 between the large diameter portion 12*a* and the swollen portion 12*c*.

The first insulator 12 is outwardly fitted with the fitting portion 11*b* of the first conductor 11. In the state wherein the first insulator 12 is outwardly fitted with the first conductor 11, the outer circumferential face of the large diameter portion 12*a* coincides with that of the flange portion 11*c*. The cable connection portion 11*d* is outwardly fitted with the swollen portion 12*c*. The electrode portion 11*a*, flange portion 11*c* and cable connection portion 11*d* of the first conductor 11 are exposed to the outside.

The second conductor 13 is formed in a substantially cylindrical shape and has an electrode portion 13*a* of a large diameter and a fitting portion 13*b* of a small diameter. A substantially annular connection portion 13*c* is formed on the first conductor 13 such that it connects the electrode portion 13*a* and the fitting portion 13*b* to each other. Further, a cable connection portion 13*d* is provided at an end of the fitting portion 13*b* remote from the connection portion 13*c*.

The second conductor 13 is outwardly fitted with the first insulator 12. In the state wherein the second conductor 13 is outwardly fitted with the first insulator 12, the electrode portion 13*a* is connected to or fitted with a portion of the large diameter portion 12*a* other than one end portion and the fitting portion 13*b* and the connection portion 13*c* are connected to or fitted with the fitting concave portion 12*d* Further, the outer circumferential face of the fitting portion 13*b* coincides with that of the swollen portion 12*c*. Accordingly, part of the large diameter portion 12 and the swollen portion 12*c* of the second insulator 12 are exposed to the outside.

The second insulator 14 is formed in a substantially cylindrical shape and has a large diameter portion 14*a* provided at an end portion thereof in the axial direction and having a diameter greater than that of the other portion, which is provided as a small diameter portion 14*b*. The large diameter portion 14*a* is formed with a thickness greater than that of the small diameter portion 14*b*. A swollen portion 14*c* is provided at an end portion of the small diameter portion 14*b* remote from the large diameter portion 14*a* and is swollen outwardly a little. Further, a shallow fitting concave portion 14*d* is formed on the outer face side of the second insulator 14 between the large diameter portion 14*a* and the swollen portion 14*c*.

The second insulator 14 is outwardly fitted with the fitting portion 13*b* of the second conductor 13. In the state wherein the second insulator 14 is fitted with the second conductor 13, the outer circumferential face of the large diameter portion 14*a* coincides with that of the electrode portion 13*a* in a radial direction. The electrode portion 13*a* and the cable connection portion 13*d* of the second conductor 13 are exposed to the outside.

The third conductor 15 is formed in a substantially cylindrical shape and has a large diameter electrode portion 15*a* and a small diameter fitting portion 15*b*. A substantially annular connection portion 15*c* is provided on the first conductor 15 and connects the electrode portion 15*a* and the fitting portion 15*b* to each other. Further, a cable connection portion 15*d* is provided at an end portion of the fitting portion 15*b* remote from the connection portion 15*c*.

The third conductor 15 is outwardly fitted with the second insulator 14. In the state wherein the third conductor 15 is outwardly fitted with the second insulator 14, the third conductor 15 is connected to or fitted with the fitting concave portion 14*d* and the outer circumferential face of the electrode portion 15*a* coincides with that of the large diameter portion 14*a* in a radial direction. Further, the outer circumferential face of the fitting portion 15*b* coincides with that of the swollen portion 14*c* in a radial direction. Accordingly, the large diameter portion 14*a* and the swollen portion 14*c* of the second insulator 14 are exposed to the outside.

The third insulator 16 is formed in a substantially cylindrical shape, and a large diameter portion 16*a* having a large outer diameter is provided at one end portion of the third insulator 16 in the axial direction. A portion of the third insulator 16 contiguous to the large diameter portion 16*a* in the axial direction is formed as a small diameter portion 16*b*, and the other end portion of the third insulator 16 in the axis direction is formed as a swollen portion 16*c* having an outer diameter greater than that of the small diameter portion 16*b*. The large diameter portion 16*a* and the swollen portion 16*c* are formed with a thickness greater than that of the small diameter portion 16*b*. A shallow fitting concave portion 16*d* is formed on the outer face side of the third insulator 16 between the large diameter portion 16*a* and the swollen portion 16*c*.

The third insulator 16 is outwardly fitted with the fitting portion 15*b* of the third conductor 15. In the state wherein the third insulator 16 is outwardly fitted with the third conductor 15, the outer circumferential faces of the large diameter portion 16*a* and the swollen portion 16*c* coincide with the outer periphery of the electrode portion 15*a* in a radial direction. In the third conductor 15, the electrode 15*a* and the cable connection portion 15*d* are exposed.

The fourth conductor 17 is formed in a substantially cylindrical shape and has an electrode portion 17*a* and an annular projection 17*b* provided in an outwardly projecting manner on the outer circumferential face at a central portion of the electrode portion 17*a* in the axial direction. A cable connection portion 17*c* is provided at a portion of the electrode portion 17*a*.

The fourth conductor 17 is outwardly fitted with the fitting concave portion 16*d* of the third insulator 16. In the state wherein the fourth conductor 17 is outwardly fitted with the third insulator 16, the outer circumferential face of the electrode portion 17*a* coincides with those of the large diameter portion 16 and the swollen portion 16*c* in a radial direction. Accordingly, the large diameter portion 16*a* and the swollen portion 16*c* of the third insulator 16 are exposed to the outside.

Figure 5:
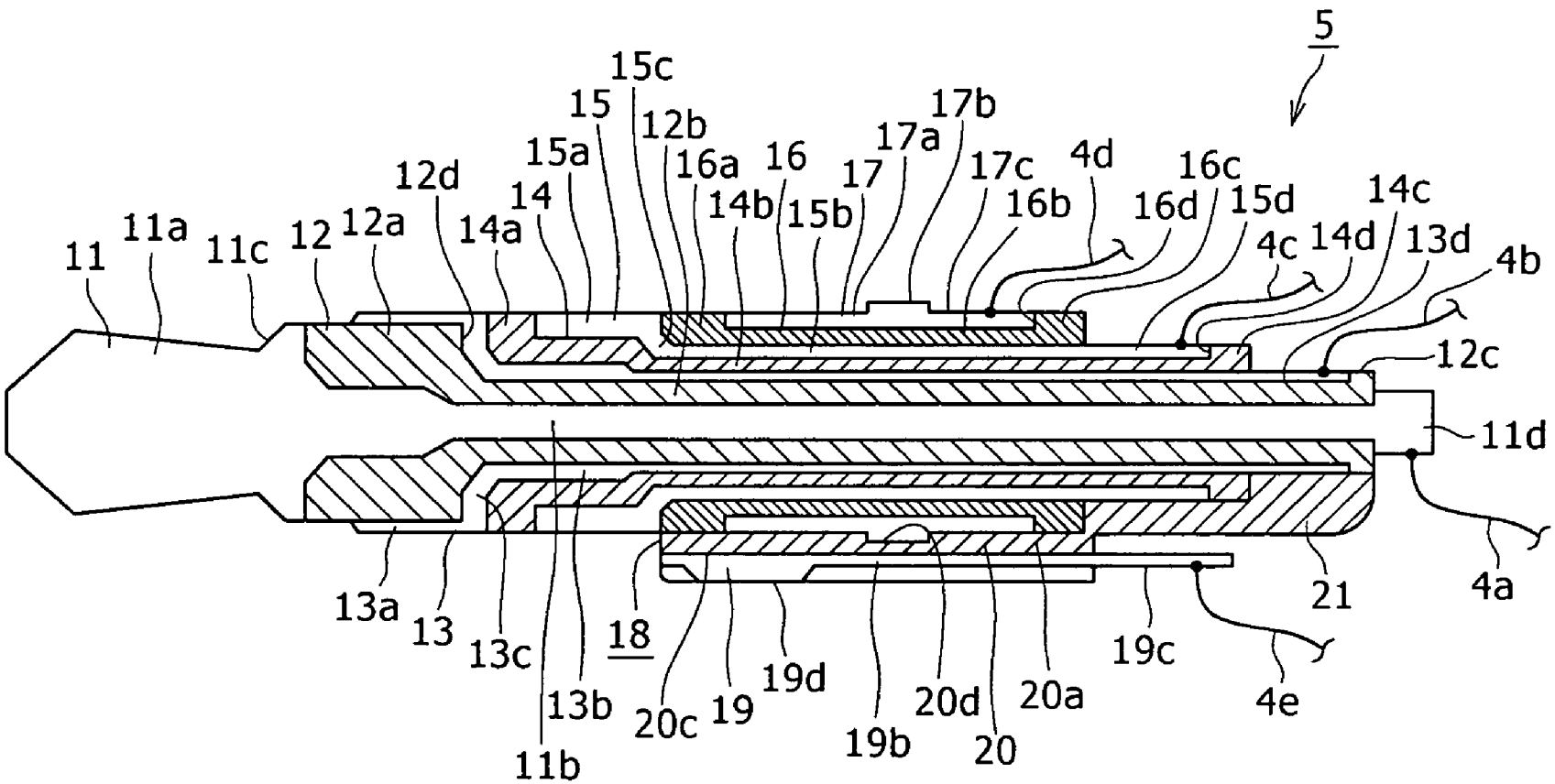
FIG. 5 is an enlarged sectional view of the plug taken a direction different from that in FIG. 4.
Figure 6:
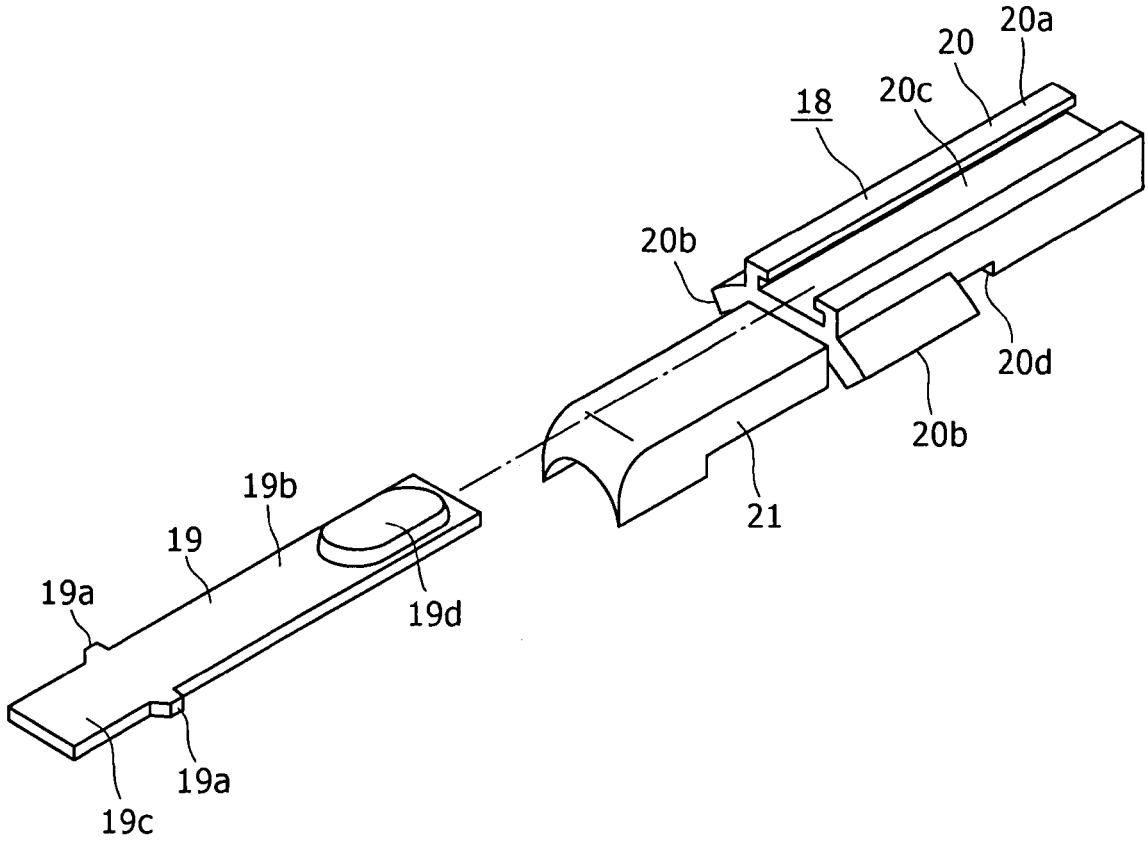
FIG. 6 is an enlarged perspective view showing a fourth insulator and a fifth conductor of the plug.

A conductor attachment portion 20 and an extension 21 are formed integrally on the outer periphery of the fourth insulator 18 as seen in FIGS. 3 and 5.

The conductor attachment portion 20 is formed long in one direction and has a main body portion 20*a* and a pair of projections 20*b* projecting in a lateral direction away from each other from an end portion of the main body portion 20*a* in a longitudinal direction. A conductor attachment groove 20*c* is formed on the main body portion 20*a* and extends in the longitudinal direction, and a fitting groove 20*d* is formed on the face of the conductor attachment portion 20 opposite to the face on which the conductor attachment groove 20*c* is formed and extends in the widthwise direction. The extension 21 is projected from an end face of the conductor attachment portion 20 in the longitudinal direction toward a direction perpendicular to the projection direction of the projections 20*b*.

The fourth insulator 18 is attached at the conductor attachment portion 20 thereof to part of the outer periphery of a portion of the third insulator 16 which extends from the large diameter portion 16*a* to the swollen portion 16*c*. Further, the fourth insulator 18 is attached at the extension 21 thereof to part of the outer periphery of a portion of the third conductor 15 which extends from the cable connection portion 15*d* to the swollen portion 12*c* of the first insulator 12. In the state wherein the fourth insulator 18 is attached in this manner, the fitting groove 20*d* is fitted with the projection 17*b* of the fourth conductor 17 and the conductor attachment portion 20 is positioned on the outer circumference side with respect to the extension 21.

The fifth conductor 19 is formed as a plate extending in one direction and has blocking projections 19*a* provided at an intermediate portion thereof in the longitudinal direction and projected away from each other. One side of the fifth conductor 19 with reference to the blocking projections 19*a* serves as an insertion portion 19*b* while the other side serves as a cable connection portion 19*c*. A connection projection 19*d* projected in a thicknesswise direction, for example, in a radial direction of the bar of the third insulator 16, is provided at an end of the insertion portion 19*b* remote from the cable connection portion 19*c*.

The fifth conductor 19 is attached to the fourth insulator 18 by inserting the insertion portion 19*b* in the conductor attachment groove 20*c* as seen in FIG. 2. In the state wherein the fifth conductor 19 is attached to the fourth insulator 18, the blocking projections 19*a* thereof contact with one end face of the main body portion 20*a* and the cable connection portion 19*c* is positioned in a spaced relationship away from the extension 21 to the outer periphery side as seen in FIG. 3.

Figure 4:
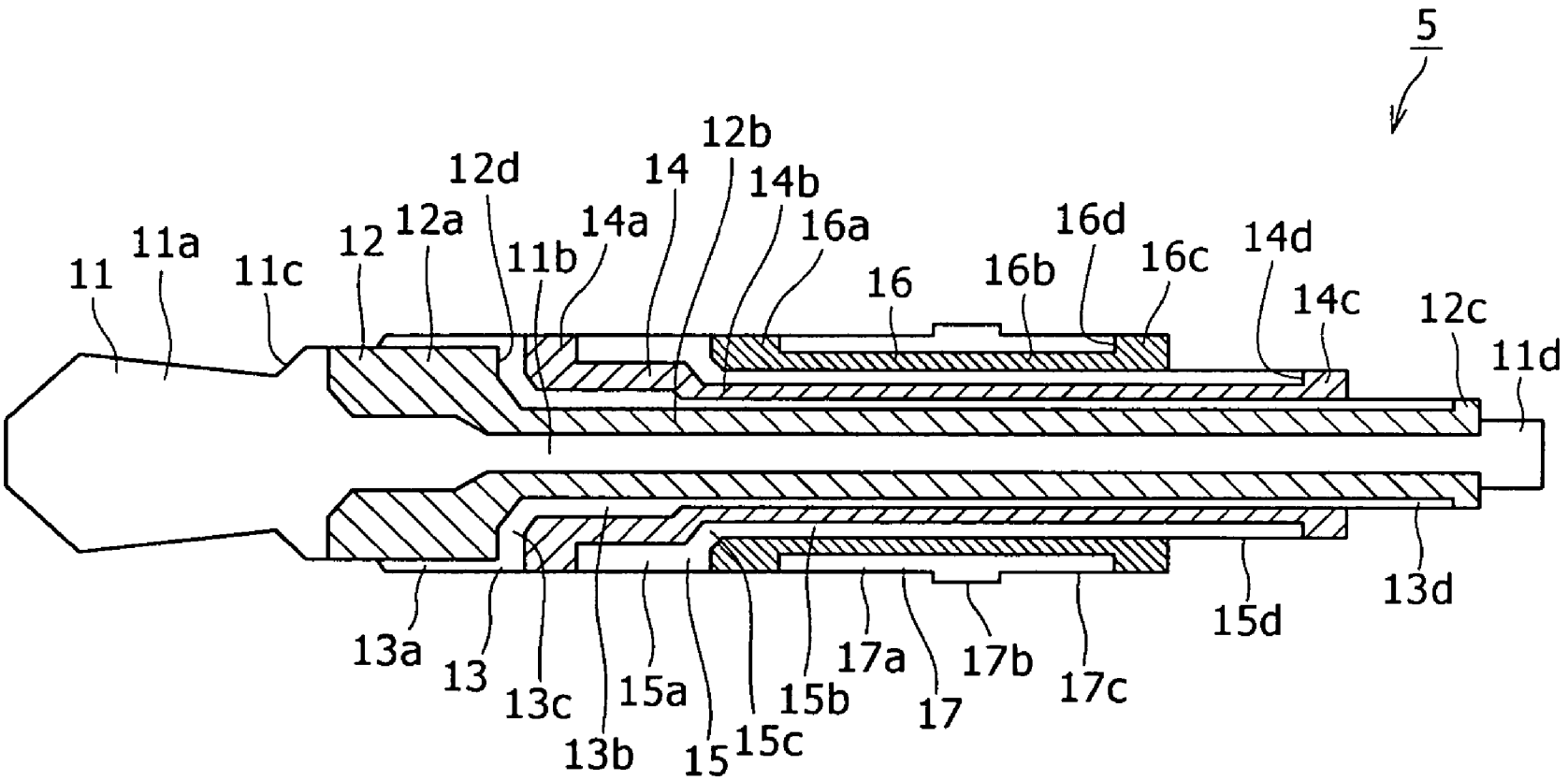
FIG. 4 is an enlarged sectional view of the plug.

Referring to FIGS. 4 and 5, in the plug 5 having the configuration described above, five connection lines 4*a*, 4*b*, 4*c*, 4*d* and 4*e* of the connection cable 4 are connected at one end portion thereof to the cable connection portions 11*d*, 13*d*, 15*d*, 17*c* and 19*c* of the first, second, third, fourth and fifth conductors 11, 13, 15, 17 and 19, respectively, by means of, for example, soldering. The connection lines 4*a*, 4*b*, 4*c*, 4*d* and 4*e* are connected at the other end thereof, for example, to the first speaker, second speaker, first microphone, grounding terminal not shown and second microphone, respectively.

In the state wherein the connection lines 4*a*, 4*b*, 4*c*, 4*d* and 4*e* are connected to the respective portions of the plug 5, a portion of the fourth conductor 17 which extends from the projection 17*b* to the cable connection portion 11*d* of the first conductor 11 is covered with a cover 10 to close up and the cable connection portions 11*d*, 13*d*, 15*d*, 17*c* and 19*c* as seen in FIG. 1.

The plug 5 is connected to the jack 23 provided on the external equipment not shown, which may be, for example, a music reproduction equipment.

Figure 7:
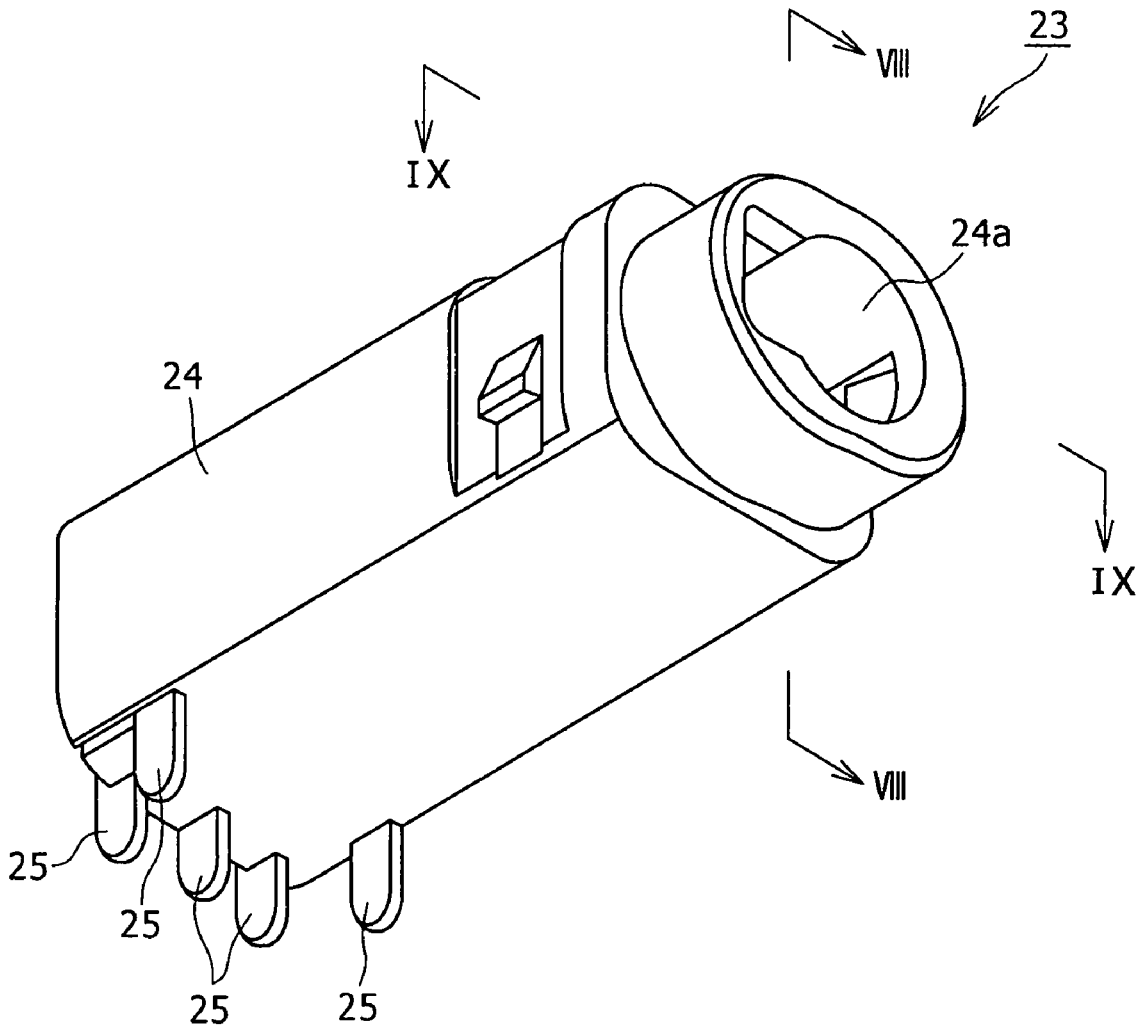
FIG. 7 is an enlarged perspective view of a jack.

Referring to FIG. 7, the jack 23 includes a housing 24 on which several components are provided. A plug insertion hole 24*a* is formed on the housing 24 such that it is open in one direction. Five terminal pieces 25 are projected from an end portion of the jack 23 remote from the opening of the plug insertion hole 24*a*. The terminal pieces 25 are connected to a control circuit not shown which is provided on the external equipment.

Figure 8:
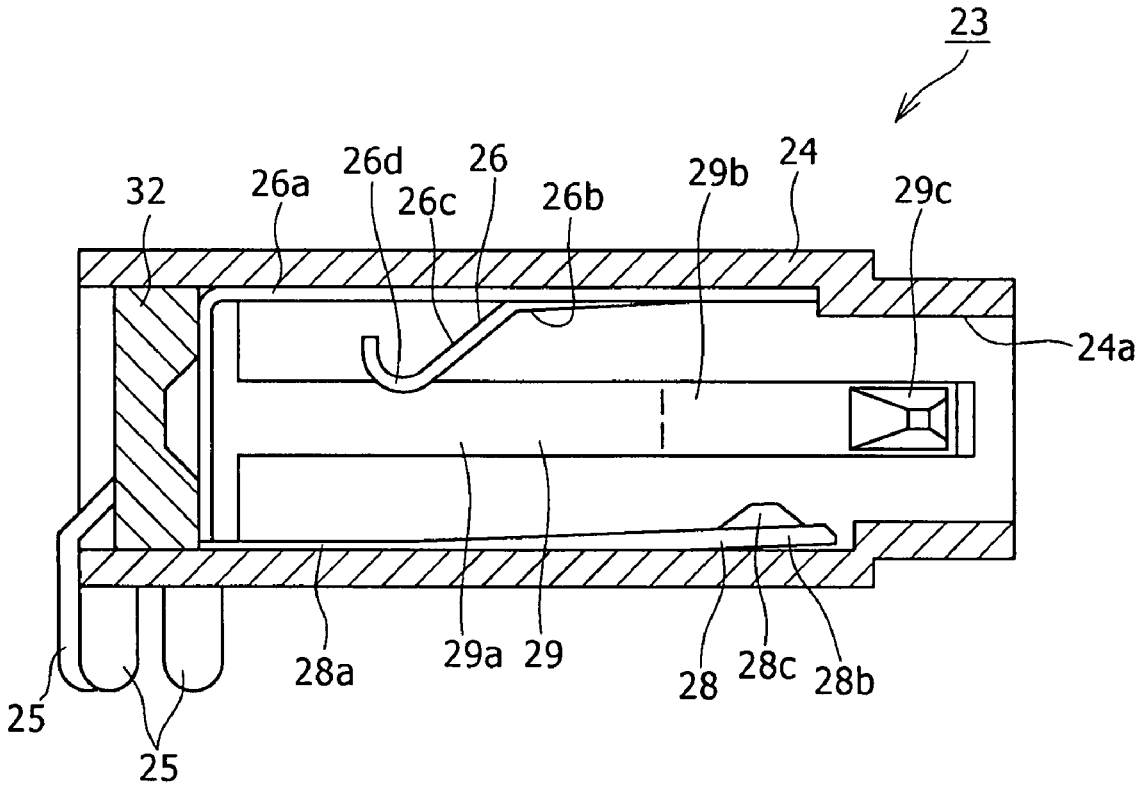
FIG. 8 is a sectional view taken along line XIII-XIII of FIG. 7.
Figure 9:
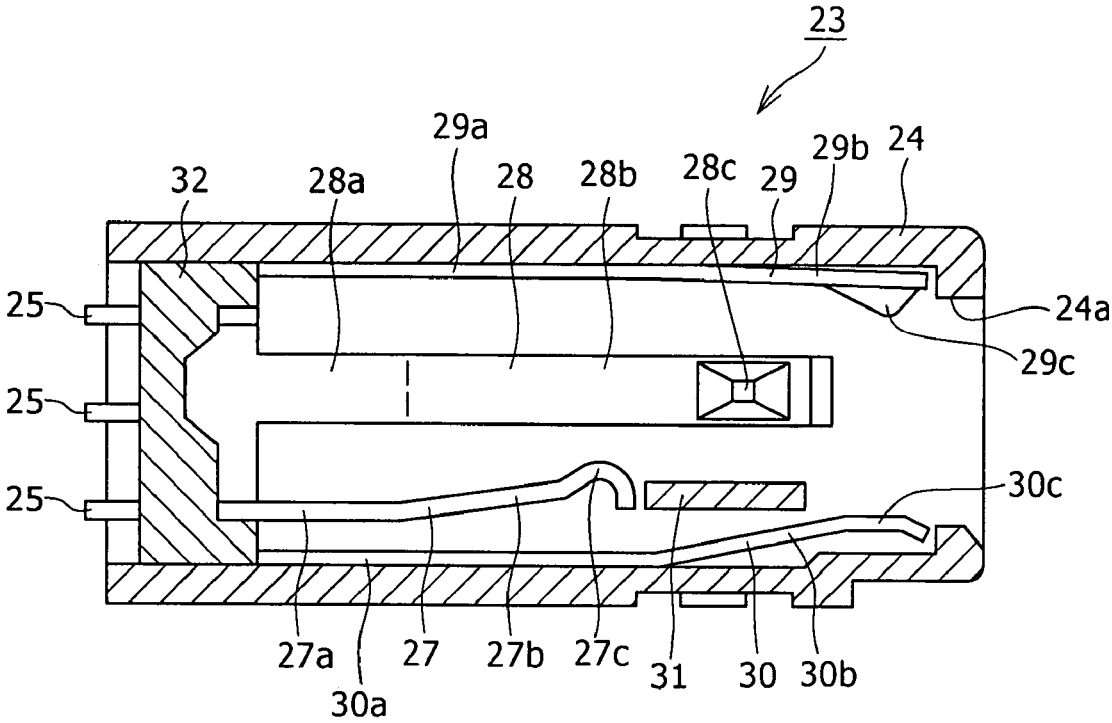
FIG. 9 is a sectional view taken along line IX-IX of FIG. 7.

Referring to FIGS. 8 and 9, the first, second, third, fourth and fifth connection terminals 26, 27, 28, 29 and 30 are disposed in the inside of the jack 23.

Referring to FIG. 8, the first connection terminal 26 has a base portion 26*a* disposed along the inner face of the jack 23, and a base end portion 26*b* folded back from the base portion 26*a* and extending in a direction away from the plug insertion hole 24*a*. The first connection terminal 26 further has a leaf spring portion 26*c* contiguous to the base end portion 26*b* and bent in a direction away from the base portion 26*a* with respect to the base end portion 26*b*. An end portion of the leaf spring portion 26*c* is formed as a connection portion 26*d*.

Referring to FIG. 9, the second connection terminal 27 has a base end portion 27*a* disposed in parallel to the inner face of the jack 23, and a leaf spring portion 27*b* contiguous to the base end portion 27*a* and bent in a direction away from the inner face of the jack 23 with respect to the base end portion 27*a*. The second connection terminal 27 further has a connection portion 27*c* provided an end portion of the leaf spring portion 27*b* thereof. The connection portion 27*c* is positioned on the plug insertion hole 24*a* side with respect to the connection portion 26*d* of the first connection terminal 26.

Referring to FIG. 8, the third connection terminal 28 has a base end portion 28*a* disposed along the inner face of the jack 23 and a leaf spring portion 28*b* contiguous to the base end portion 28*a* and curved in a direction away from the inner face of the jack 23 with respect to the base end portion 28*a*. A connection portion 28*c* is provided at an end portion of the leaf spring portion 28*b*. The connection portion 28*c* is positioned on the plug insertion hole 24*a* side with respect to the connection portion 27*c* of the second connection terminal 27.

Referring to FIGS. 8 and 9, the fourth connection terminal 29 has a base end portion 29*a* disposed along the inner face of the jack 23, and a leaf spring portion 29*b* contiguous to the base end portion 29*a* and bent in a direction away from the inner face of the jack 23 with respect to the base end portion 29*a*. A connection portion 29*c* is provided at an end portion of the leaf spring portion 29*b*. The connection portion 29*c* is positioned adjacent the plug insertion hole 24*a* with respect to the connection portion 28*c* of the third connection terminal 28 and just on the inner side of the opening of the plug insertion hole 24*a*.

Referring to FIG. 9, the fifth connection terminal 30 has a base end portion 30*a* disposed along the inner side of the jack 23, and a leaf spring portion 30*b* contiguous to the base end portion 30*a* and bent in a direction away from the inner face of the jack 23 with respect to the base end portion 30*a*. A connection portion 30*c* is provided at an end portion of the leaf spring portion 30*b*. The connection portion 30*c* is positioned just on the inner side of the opening of the plug insertion hole 24*a*.

A stopper wall 31 is provided inside the jack 23. The stopper wall 31 is positioned remotely from the inner face of the jack 23 with respect to the leaf spring portion 30*b* of the fifth connection terminal 30.

Referring to FIGS. 8 and 9, a retaining insulating member 32 is provided inside the jack 23. The retaining insulating member 32 is provided at an end portion of the plug insertion hole 24*a* remote from the opening.

The first, second, third, fourth and fifth connection terminals 26, 27, 28, 29 and 30 are retained with a portion thereof embedded in the retaining insulating member 32 and are individually connected to the terminal pieces 25. Accordingly, the first, second, third, fourth and fifth connection terminals 26, 27, 28, 29 and 30 are connected to the control circuit provided in the external apparatus through the respective terminal pieces 25.

Figure 10:
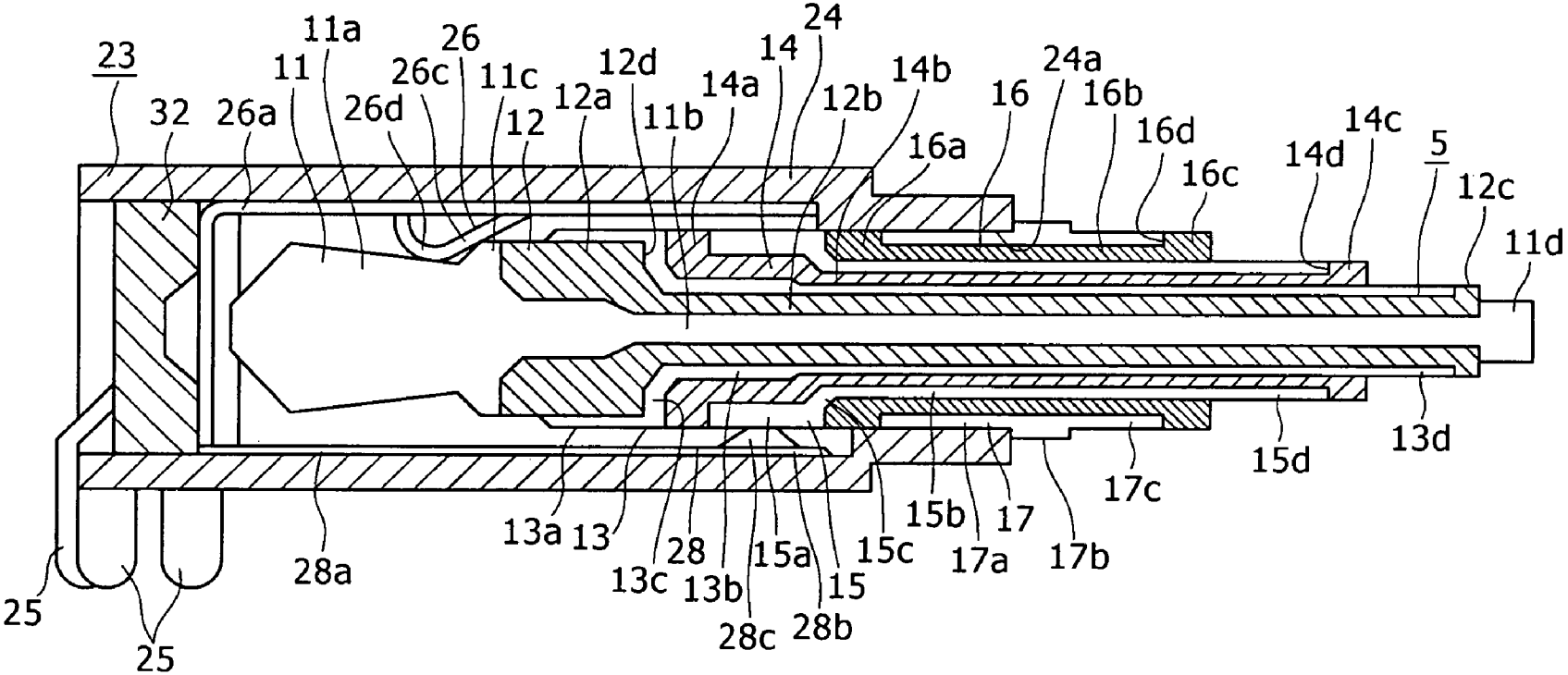
FIG. 10 is an enlarged sectional view of the plug in a state wherein it is connected to the jack.
Figure 11:
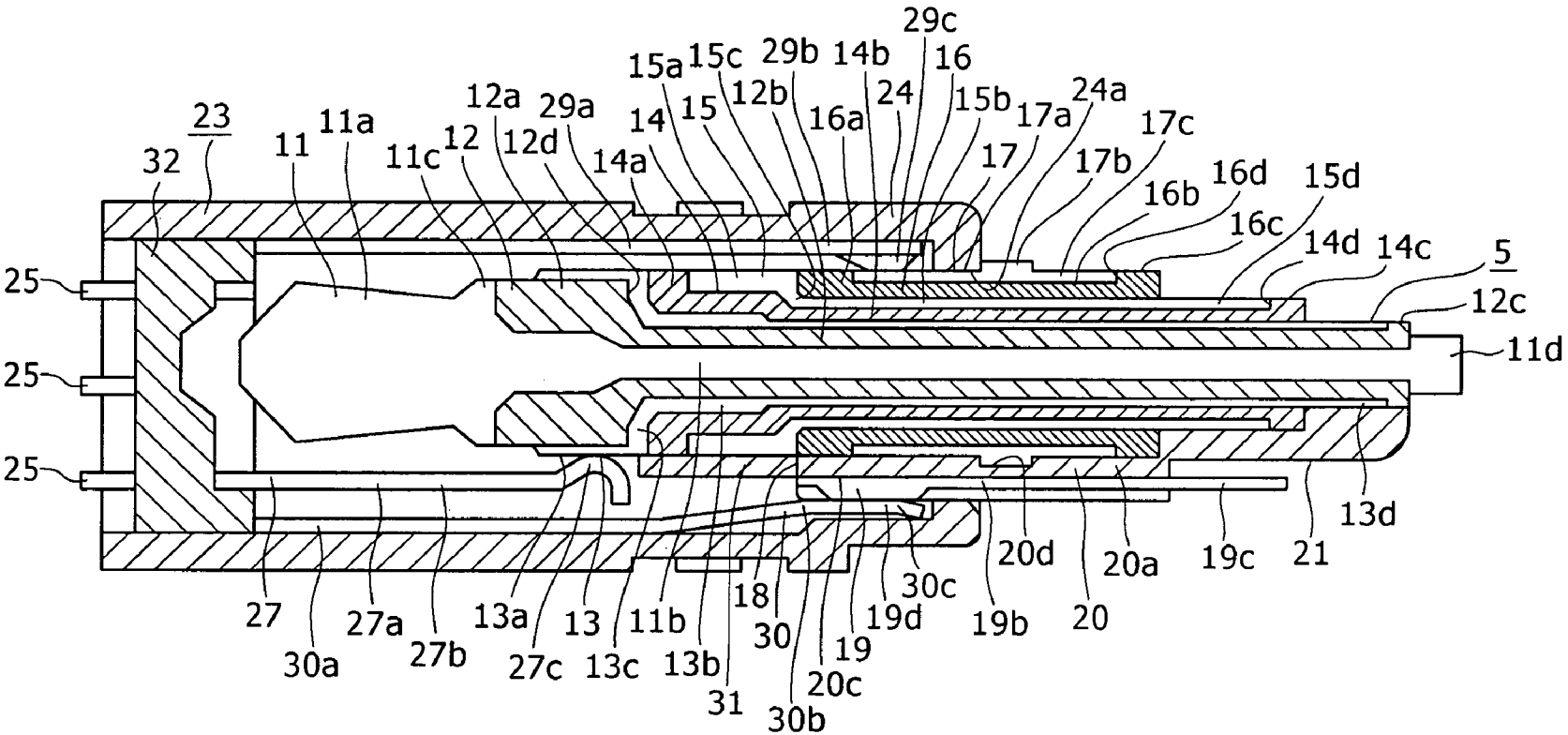
FIG. 11 is an enlarged sectional view showing the plug in the state wherein it is connected to the jack as viewed from a direction different from that in FIG. 10.

Referring to FIGS. 10 and 11, when the plug 5 is inserted in the plug insertion hole 24*a*, the electrode portion 11*a* of the first conductor 11, electrode portion 13*a* of the second conductor 13, electrode portion 15*a* of the third conductor 15, electrode portion 17*a* of the fourth conductor 17 and connection projection 19*d* of the fifth conductor 19 are connected to the connection portion 26*d* of the first connection terminal 26 for the first speaker, connection portion 27*c* of the second connection terminal 27 for the second speaker, connection portion 28*c* of the third connection terminal 28 for the first microphone, connection portion 29*c* of the fourth connection terminal 29 for grounding, and connection portion 30*c* of the fifth connection terminal 30 for the second microphone, respectively.

At this time, the plug 5 is inserted to a position at which the projection 17*b* of the fourth conductor 17 contacts with the outer side opening edge of the plug insertion hole 24*a* of the jack 23 and one end face of the insertion portion 19*b* of the fifth conductor 19 contacts with the stopper wall 31. Thus, the plug 5 is positioned with respect to the jack 23 in the insertion direction.

The connection portions 26*d*, 27*c*, 28*c*, 29*c* and 30*c* are resiliently deformed against the spring force with respect to the base end portions 26*b*, 27*a*, 28*a*, 29*a* and base end portion 30*a*, respectively, and are connected in a state wherein they are pressed against the electrode portion 11*a*, electrode portion 13*a*, electrode portion 15*a*, electrode portion 17*a* and connection projection 19*d*.

To the jack 23, for example, also a plug of a three-pole configuration can be connected.

Figure 12:
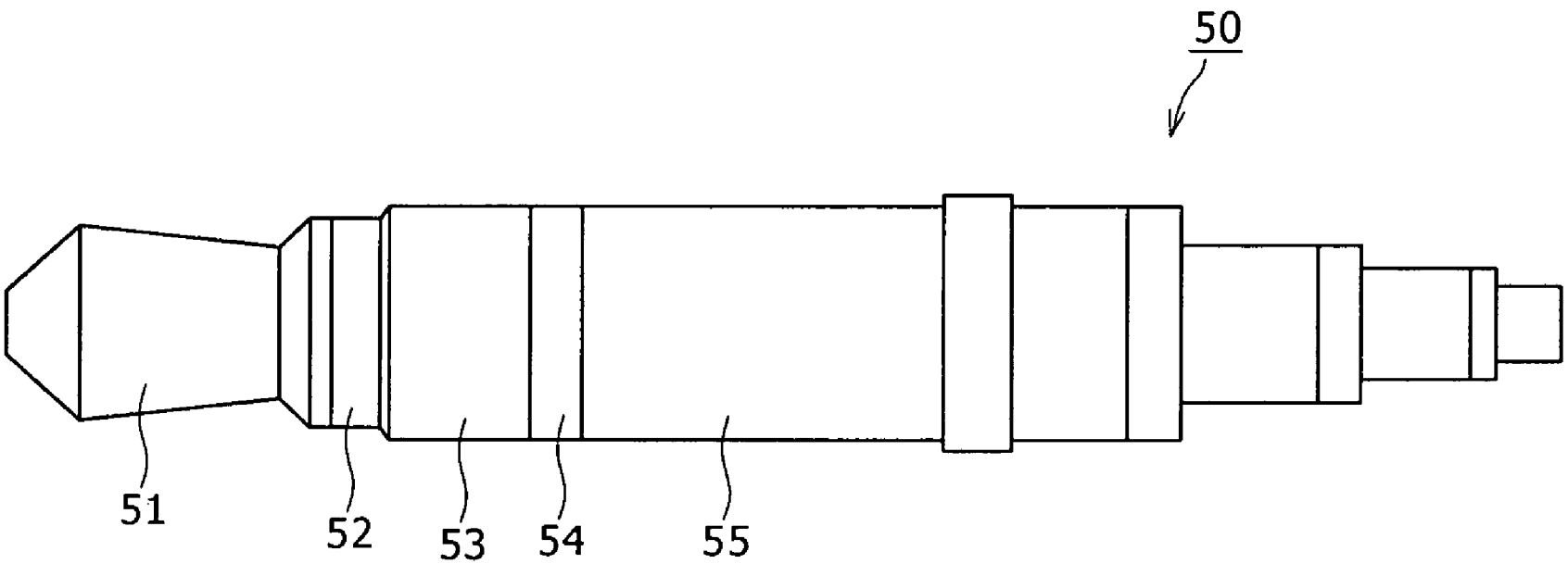
FIG. 12 is an enlarged side elevational view showing a plug having a three-pole configuration.
Figure 13:
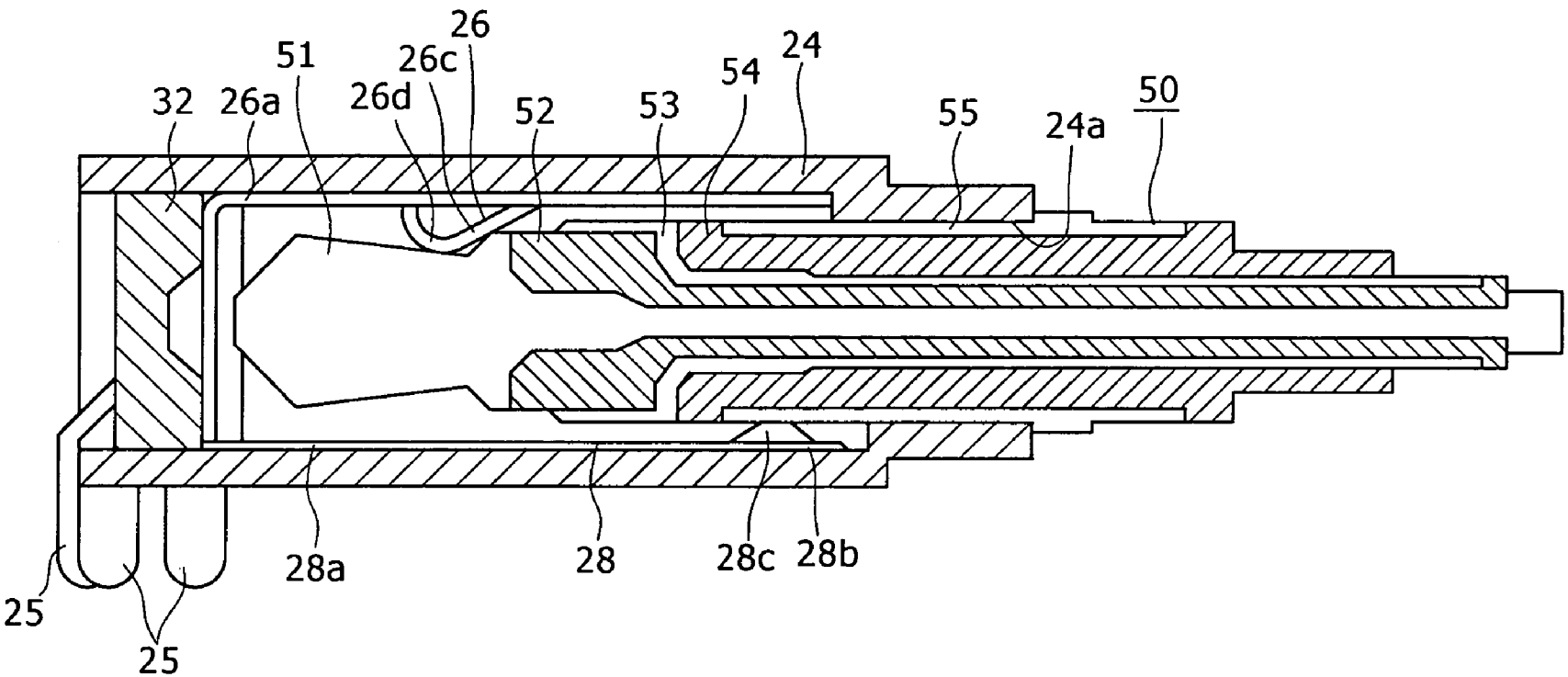
FIG. 13 is an enlarged sectional view showing a the plug of a three-pole configuration in a state wherein it is connected to the jack.
Figure 14:
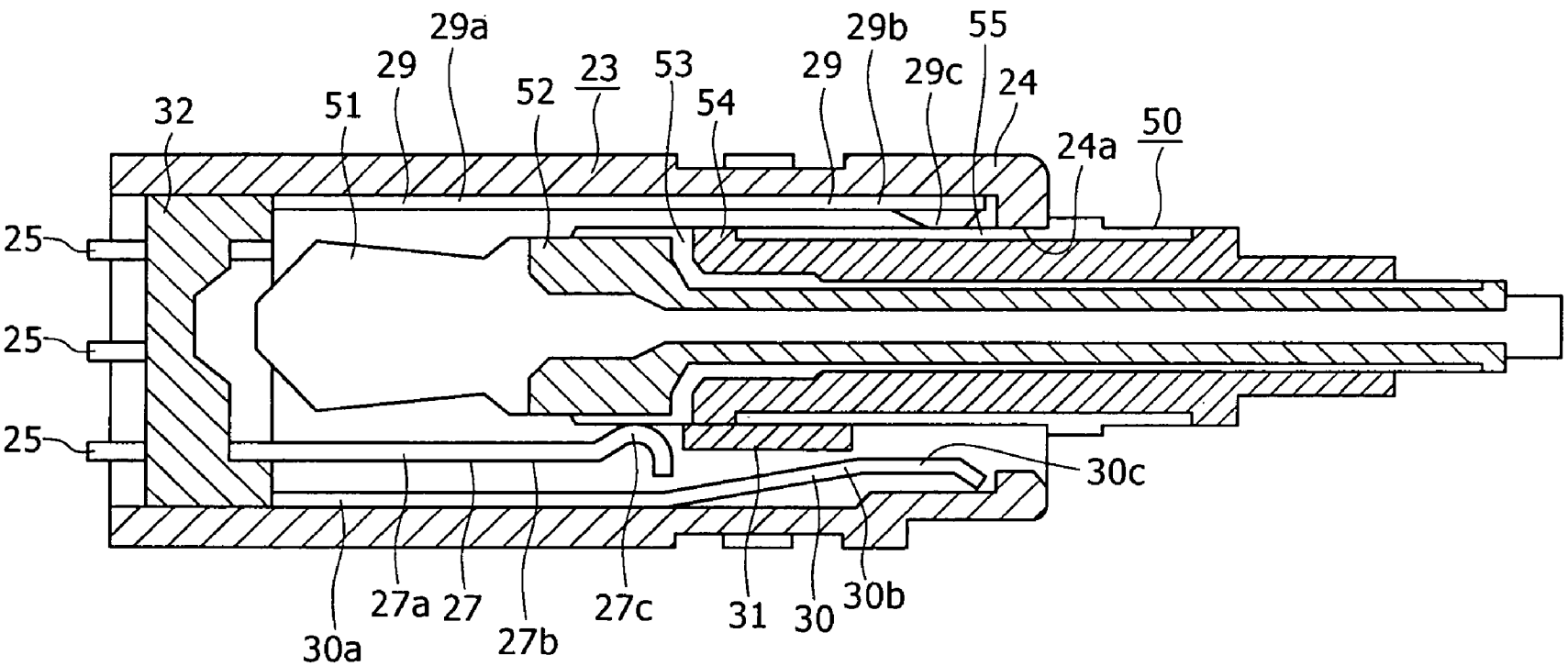
FIG. 14 is an enlarged sectional view showing the plug of a three-pole configuration wherein it is connected to the jack as viewed from a direction different from that in FIG. 13.

Referring now to FIGS. 12 to 14, there is shown a plug 50 of the three-pole type. The plug 50 of the three-pole type shown includes a first conductor 51, a first insulator 52 outwardly fitted on the first conductor 51, a second conductor 53 outwardly fitted on the first insulator 52, a second insulator 54 outwardly fitted on the second conductor 53 and a third conductor 55 outwardly fitted on the second insulator 54. In a state wherein the plug 50 is connected to the jack 23, the first conductor 51 is connected to the first connection terminal 26 for the first speaker and the second conductor 53 is connected to the second connection terminal 27 for the second speaker while the third conductor 55 is connected to the fourth connection terminal 29 for grounding. The plug 50 is not connected to the fifth connection terminal 30 for the second microphone.

While the plug 50 is configured such that the third conductor 55 thereof contacts also with the third connection terminal 28 for the first microphone, the control circuit of the external apparatus is configured such that no signal is communicated between the third conductor 55 and the third connection terminal 28. It is to be noted that, for example, the arrangement position of the third connection terminal 28 of the jack 23 may be changed so that, when the plug 50 is connected to the jack 23, the third conductor 55 is not connected to the third connection terminal 28.

As described above, the plug 5 of a five-pole configuration can be formed readily because the five poles thereof are formed by attaching a portion of one pole to an outer circumferential face of the four-pole configuration portion formed as a substantially bar.

Further, since the fifth conductor 19 is formed as a plate and attached at one face thereof in the thicknesswise direction to the fourth insulator 18, the overall outer diameter of the plug 5 can be reduced. Consequently, miniaturization of the plug 5 can be anticipated.

Further, since the connection projection 19*d* which functions as an electrode portion is provided on the fifth conductor 19, a good connection property of the plug 5 to the fifth connection terminal 30 of the jack 23 can be assured.

In addition, in the plug 5, the fourth insulator 18 and the fifth conductor 19 are attached to the four-pole configuration portion formed as a substantially bar. Therefore, the fourth insulator 18 and the fifth conductor 19 are shaped such that they are projected sidewardly from the portion in the form of the substantially bar. Consequently, for example, erroneous insertion of the plug 5 into a jack for exclusive use for a plug of a three-pole configuration wherein the plug insertion hole is formed in a circular shape can be prevented.

While a preferred embodiment of the present invention has been described using specific terms, such description is for illustrative purposes only, and it is to be understood that changes and variations may be made without departing from the spirit or scope of the following claims.

What is claimed is:

1. A plug, comprising:

a first conductor formed as a bar and having a first electrode portion and a first fitting portion;

a first insulator outwardly fitted with the fitting portion of said first conductor;

a second conductor outwardly fitted with said first insulator and having a second electrode portion and a second fitting portion, said second conductor being isolated from said first conductor by said first insulator;

a second insulator outwardly fitted with the fitting portion of said second conductor;

a third conductor outwardly fitted with said second insulator and having a third electrode portion and a third fitting portion, said third conductor being isolated from said second conductor by said second insulator;

a third insulator outwardly fitted with the fitting portion of said third conductor;

wherein the first, second, and third electrodes of said first, second and third conductors are formed with a diameter greater than that of the fitting portions;

each of said first, second and third insulators individually have a large diameter portion exposed at least part thereof to the outer face and a small diameter portion having a diameter smaller than that of the large diameter portion; and the fitting portions of said second and third conductors and said fourth conductor are outwardly fitted with the small diameter sections of said first, second and third insulators, respectively, a fourth conductor outwardly fitted with said third insulation portion and having a fourth electrode portion, said fourth conductor being isolated from said third conductor by said third insulator;

a fourth insulator attached at least to a portion of the outer face of said fourth conductor;

wherein said fourth insulator is formed for engagement with the large diameter portion of said third insulator; and a fifth conductor attached to said fourth insulator.

2. The plug according to claim 1, wherein said first conductor is formed substantially as a bar, and said second, third and fourth conductors and said first, second and third insulators are formed in a substantially circular cylindrical shape.

3. The plug according to claim 1, wherein said fourth insulator has said fifth conductor inserted therein and has a conductor attachment groove for retaining said fifth conductor, and said fifth conductor has an insertion portion inserted in said conductor attachment groove.

4. The plug according to claim 3, wherein said fifth conductor has, at one end of the insertion portion thereof, a connection projection for establishing connection to a jack.

5. The plug according to claim 4, wherein said fifth conductor has a blocking projection for engaging an end face of said fourth insulator to block the insertion portion of said fifth conductor against insertion into the conductor attachment groove.

6. The plug according to claim 5, wherein said fifth conductor has code connection portion provided at an end thereof remote from the insertion portion with respect to the blocking projection.

7. The plug according to claim 1, wherein said first, second, third and fourth conductors individually include a cable connection portion provided remotely from the electrode portion;

each of said first, second and third insulators individually have a swollen portion provided remotely from the corresponding large diameter portion; and said fourth insulator has an extension for engaging wit the swollen portion of said first insulator.

8. The plug according to claim 7, wherein said fourth conductor has a projection provided between the electrode portion and the code connection portion thereof and projected in a radial direction of the bar; and said fourth insulator has a fitting groove for fitting with the projection.

9. The plug according to claim 8, further comprising a cover for closing up the code connection sections of said first, second, third and fourth conductors.

* * * * *